United States Patent [19]

Quinn

[11] 4,411,585

[45] Oct. 25, 1983

[54] FORK ATTACHMENT FOR LOADER BUCKETS

[75] Inventor: Russell C. Quinn, Twinsburg, Ohio

[73] Assignee: Jos. Dyson and Sons, Inc., Eastlake, Ohio

[21] Appl. No.: 244,298

[22] Filed: Mar. 16, 1981

[51] Int. Cl.[3] ..... B66F 9/12

[52] U.S. Cl. ..... 414/724; 37/DIG. 3; 37/DIG. 12; 172/253

[58] Field of Search ..... 414/724; 37/DIG. 3, 37/DIG. 12, 117.5, 141 R, 141 T; 172/245, 250, 172/253

[56] References Cited

U.S. PATENT DOCUMENTS

| | | | |
|---|---|---|---|
| 3,325,023 | 6/1967 | Coleman | 414/724 |
| 3,349,933 | 10/1967 | Simpson et al. | 414/724 |
| 3,942,271 | 3/1976 | George | 414/724 X |
| 4,120,105 | 10/1978 | Stepe | 37/141 T |
| 4,125,952 | 11/1978 | Jennings | 414/724 X |

FOREIGN PATENT DOCUMENTS

| | | | |
|---|---|---|---|
| 937195 | 8/1948 | France | 37/141 R |

*Primary Examiner*—Robert J. Spar
*Assistant Examiner*—Donald W. Underwood
*Attorney, Agent, or Firm*—Frank B. Robb

[57] ABSTRACT

An attachment for buckets of vehicles known as front end loaders or the like, which consist of one or more, usually a pair of generally flat fork bodies removably positionable at the open end of the bucket of such a loader, the fork bodies being supported below the bucket, closely connected thereto by a bucket edge gripping bar extending along the bucket edge which provides for adjustment of the bodies at the edge, fasteners engaging suitably formed parts of each body and the bar, to maintain the attachment in place, to facilitate operation of the loader as a fork lift.

1 Claim, 3 Drawing Figures

FORK ATTACHMENT FOR LOADER BUCKETS

BACKGROUND AND GENERAL DESCRIPTION OF THE INVENTION

The prior art includes a number of different ways of converting a front end loader to fork lift operation, by fastening fork parts of one kind or another thereto, including the use of clamping means to maintain the parts in position at the open side of the bucket, requiring the operator to manhandle the same and resulting in concentrating stresses at the bucket edge, often necessitating very special fork design to accommodate the formation of the bucket.

Further since the operator in prior constructions, must resort to several hand operations for positioning as well as fastening forks to buckets, and the ultimate combination does not always perform as desired, since the attached forks often become misaligned, lost time for adjustment is not unusual.

In the instant concept, the generally flat fork bodies are availed of, and include in the usual combination, a pair of such bodies, each of which have a lifting section extending forwardly of the bucket edge, a portion extending rearwardly of the edge and beneath the bucket bottom, the portion in each having a stop element to coact with a shoulder to prevent displacement thereof.

The fork bodies are spaced at the edge and maintained in position thereat by edge gripping means which provide for variation of spacing, receiving fasteners which in turn engage fastener parts of each body, and in addition the gripping means are provided with a guide member which facilitates positioning of the assembly as a unit, at the edge of the bucket, by manipulation of the machine and bucket, to eliminate necessity for hand positioning of the fork bodies by the operator or helper.

With the foregoing in mind, the invention specifically contemplates availing of relatively simple fork bodies, providing fastener parts thereon, positioning stop elements to maintain the bodies in place, assembling the bodies into an attachable unit at predetermined spacing, enabling the interengagement of the assembly at a bucket edge without endangering the operator and completing the fastening in such a manner as to distribute lifting forces over the bucket bottom whilst preventing displacement of the thus fastened assembly, until such time as desired.

Special objects and advantages of the disclosure herein will be explained and described in detail in the specification appended hereto and disclosed in the drawing wherein.

DETAILED DESCRIPTION OF THE INVENTION

Figure 2:
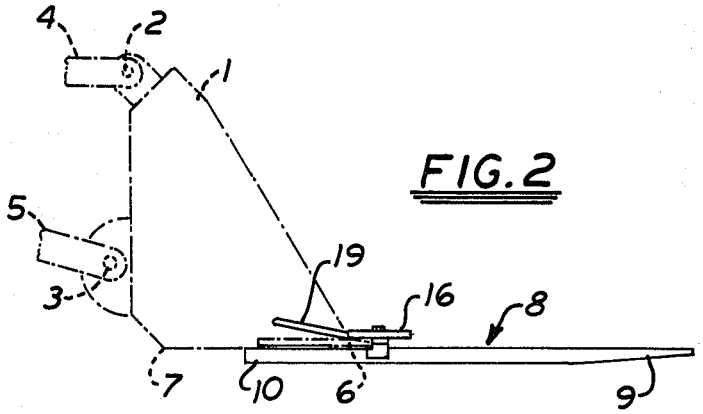
FIG. 2 is a somewhat diagrammatic side elevational view of a bucket shown in phantom with the assembly hereof fastened at the edge.
Figure 3:
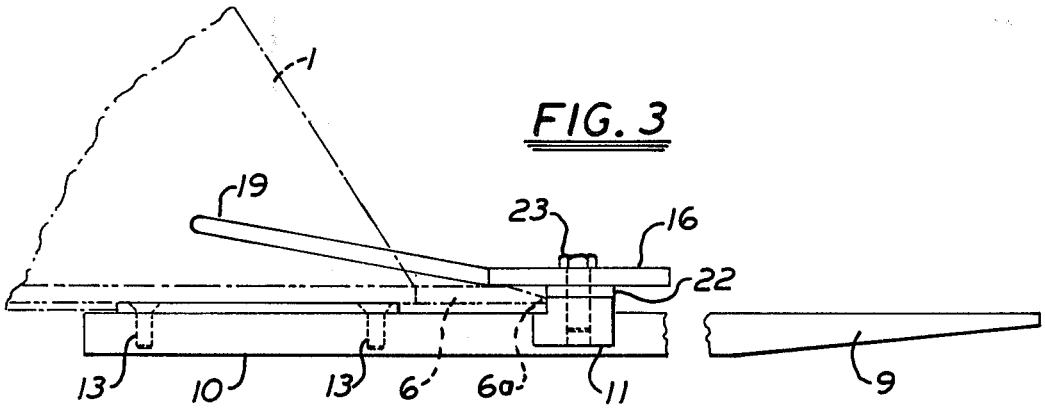
FIG. 3 is an enlarged fragmentary view similar to FIG. 2 showing in greater detail the construction and fastening arrangement.

Referring initially to FIGS. 2 and 3, a front end loader bucket is indicated in dotted lines at 1, connected by the usual fastening such as 2 and 3, to a front end loader not shown, by means of the links such as 4 and 5.

Such buckets are usually equipped with a cutting blade or edge indicated at 6 in FIG. 3, which cutting edge is fastened at the open lower side of the bucket the bottom of the bucket being designated 7 and this cutting edge being an extension thereof and fastened thereto usually being of hard material so as to resist wear in the usual operation of the bucket as a front end loader, being well known in the art and thus not shown further in detail.

Figure 1:
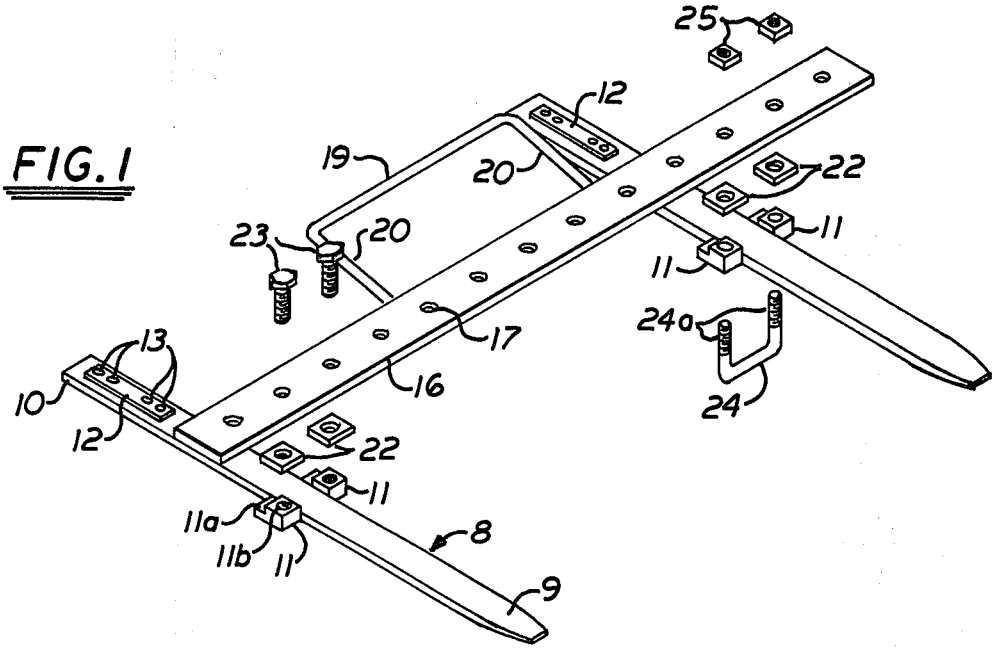
FIG. 1 is a perspective, exploded view showing the various elements of the assembly hereof, with variations suggested.

With the foregoing in mind, the attachment hereof is shown and described in relation to the bucket, but more in detail in FIG. 1 as comprising a pair of generally flat fork bodies designated 8, and since they are identical, the same designation will be used for each.

Such flat fork bodies 8 include a lifting section 9 at the forward end of each, and a bucket engaging portion 10 at the rear of each said body, the division being arbitrary as will be apparent, but in this instance being formed or generally located by means of the fastener parts 11 a pair of which is provided for each fork body one at each side thereof for purposes which will presently appear.

On the upper surface at the bucket engaging portion 10 of each fork, a stop element 12 is provided, fastened by means of suitable fasteners 13, in this instance being shown in dotted lines in FIG. 3 as flat head cap screws.

The stop elements 12 are arranged to be positioned in different positions in this instance two such positions being suggested by the provision of a separate pair of openings therein, these stop elements being formed of flat stock of some thickness and width and length to enable their location as suggested, the various openings therein such as 14 and 15, being arranged so that the stop element may be located in two different positions either forwardly or rearwardly as will be apparent.

The reason for arranging the stop elements in this manner is to accommodate for different widths of cutting edges 6, which are in some instances of one depth or width so to speak, and in effect really wider therefore, as opposed to narrower such elements in different manufactured buckets.

The fork bodies 8, are arranged so as to be fastened to a bucket edge gripping means 16, which is a bar of some considerable length extending over a substantial area of the cutting edge and of a suitable width so as to have a series of openings 17 therein, through which fasteners may be entered as will be presently explained.

This bucket edge gripping means 16 as indicated being a flat bar like element, is in turn equipped with a guide member 19, which is of U-shaped configuration having the arms 20 extending forwardly and fastened at their extremities, forward extremities, gripping means 16 by welding or other suitable means.

The guide member 19 as will be noted from FIGS. 2 and 3, extends upwardly at an angle from the plane of the gripping means 16 in order to provide the advantages subsequently to be set forth in conjunction with an explanation of the operation of the assembly as an attachment.

The fastener parts 11 previously mentioned, are as indicated in each case equipped with a step **11*a*, at the rear portion thereof as viewed with the lifting sections of each fork body 8 extending forwardly, and further the upper face of each of these fastener parts designated 11*b***, is located at a position somewhat above the plane of the lifting section of the fork body in each case.

This step formation, previously mentioned, is of such a height above the plane of the surface of the body as to provide a stop for the edge of the bucket which edge as shown in FIG. 3 is designated 6*a*.

If the cutting edge part of the body is of one thickness, it may be necessary to provide spacers such as indicated at 22, these all being identical and really just square washers, which may be positioned as suggested in FIG. 3 at the upper surface on the surface 11*b* of the fastener parts 11.

From the foregoing it will be understood that the fasteners which are indicated at 23, and being in the form of hex head machine screws, are intended to be entered through suitable openings 17 in the gripping means 16 through the corresponding openings in the spacers 22 and into the threaded openings formed in the fastener parts 11, so as to connect all these parts together.

This is shown in assembled position in FIGS. 2 and 3, at the edge of the bucket with the fasteners 23 in tightened condition.

It is pointed out that a different kind of a fastener such as 24 which may be what is termed a U-bolt can be used, in which case the fastener parts 11 are unthreaded and the U-bolt 24 itself provided with threads 24*a* on each of its branches.

Obviously use of the U-bolt 24 is such as to permit the entry of the same upwardly from below the fork body 8, through the fastener parts 11, the spacers 22 to be engaged by nuts 25 above the surface or plane of the gripping means 16.

Turning now to a consideration of the method of assembling the thus previously described attachment to a bucket or the like, it will be noted that initially the fasteners 23 are relatively loosely assembled in connected position with the fastener parts 11, engaging the bucket edge gripping means 16 by the opening 17 thereof, so that the guide member 19 is about in the position shown in FIG. 3.

Thereafter the operator of the machine to which the bucket is attached, will manipulate the machine so that the bucket edge 6 and specifically the sharpened section 6*a* thereof, enters below the guide member 19 and thus below the gripping means 16, so as to engage the shoulders 11*a* of the fastener parts 11. When this is accomplished, the operator may thereafter get down from the machine, move forward with a wrench and fasten the fasteners 23 in each case sufficiently tightly so that the gripping means 16 does in fact grip above the cutting edge of the bucket.

Thereafter since the bucket engaging portion 10 of each fork body is located as suggested in FiG. 3 below the bottom of the bucket, the stop element 12 in each case will engage the bottom of the bucket and the forward edge thereof be positioned behind the cutting edge 6 which extends below the bottom of the bucket. Thus the stop element prevents subsequent displacement of the assembly of the attachment when backward motion of the bucket is effected during backing of the machine, and thus the attachment as a whole is maintained in position of course in conjunction with the gripping means 16 pressing downwardly at the upper surface of the cutting edge 6.

By the same reasoning, the disassembly of the attachment may be effected by loosening the fasteners 23, placing the attachment on the ground and backing the machine and bucket 1 away from the same, for subsequent use as a loading means and bucket in its usual form.

When fork lift operation is desired, the attachment hereof may be assembled as previously mentioned for use, it being noted of course that the position of the respective fork bodies may be changed transversely by positioning the fasteners 23 in different openings 17 or different pairs of openings so to speak since a fastener is provided at each side of the fork body.

It is notable that the arrangement thus set forth, in large measure prevents the angular displacement of the fork bodies and assures the ease of assembly of the attachment to and the disassembly from a bucket for use in any conventional way.

I claim:

1. An attachment for a loader bucket comprising a pair of substantially generally flat fork bodies, each said body including a lifting section and a bucket engaging portion, each bucket engaging portion having a stop element connected to the bucket engaging portion to coact with a shoulder form at the underside of such bucket, bucket edge gripping means for frictionally positioning such means on the upper side at an edge of such bucket, said gripping means extending between said bodies and comprising a transversely elongated member having provisions for receiving fasteners which do not penetrate the bucket or bucket edge, and which engage said gripping and fastening means to prevent displacement of the fork bodies from such loader bucket, and fastening means for the fork body positioned in the elongated member to retain the fork bodies in related positions.

* * * * *